US009162101B2

(12) United States Patent
Zondervan et al.

(10) Patent No.: US 9,162,101 B2
(45) Date of Patent: Oct. 20, 2015

(54) APPARATUSES AND METHODS FOR EXERCISING THE ARM

(71) Applicant: The Regents of the University of California, Oakland, CA (US)

(72) Inventors: Daniel Zondervan, Irvine, CA (US); David Reinkensmeyer, Irvine, CA (US)

(73) Assignee: The Regents of the University of California, A California Corporation, Oakland, CA (US)

( * ) Notice: Subject to any disclaimer, the term of this patent is extended or adjusted under 35 U.S.C. 154(b) by 89 days.

(21) Appl. No.: 13/840,734

(22) Filed: Mar. 15, 2013

(65) Prior Publication Data

US 2013/0324379 A1 Dec. 5, 2013

Related U.S. Application Data

(60) Provisional application No. 61/654,371, filed on Jun. 1, 2012.

(51) Int. Cl.

| | |
|---|---|
| ***A63B 21/04*** | (2006.01) |
| ***A63B 21/02*** | (2006.01) |
| ***A61G 5/10*** | (2006.01) |
| ***A61G 7/10*** | (2006.01) |
| ***A63B 71/00*** | (2006.01) |
| ***A63B 21/055*** | (2006.01) |

(Continued)

(52) U.S. Cl.

CPC . *A63B 21/04* (2013.01); *A61G 5/10* (2013.01); *A61G 7/10* (2013.01); *A63B 21/0421* (2013.01); *A63B 21/0552* (2013.01); *A63B 21/1434* (2013.01); *A63B 21/1442* (2013.01); *A63B 21/1465* (2013.01); *A63B 23/03508* (2013.01); *A63B 23/1209* (2013.01); *A63B 71/0009* (2013.01); *A61G 2203/42* (2013.01); *A63B 21/023* (2013.01); *A63B 21/1469* (2013.01); *A63B 2022/0094* (2013.01); *A63B 2071/0018* (2013.01)

(58) Field of Classification Search

CPC .... A63B 21/02; A63B 21/04; A63B 21/0421; A63B 21/0442; A63B 21/055; A63B 21/0552; A63B 21/0557; A63B 23/12; A63B 23/1281

USPC ..... 482/44–50, 121, 129–130, 904

See application file for complete search history.

(56) References Cited

U.S. PATENT DOCUMENTS 2,855,199 A * 10/1958 Noland et al. ..... 482/97
2,876,486 A * 3/1959 Lindstrom ..... 16/421

(Continued)

OTHER PUBLICATIONS

Sanchez RJ, Liu J, Rao S, Shah P, Smith R, Cramer SC, Bobrow JE, Reinkensmeyer DJ:Automating arm movement training following severe stroke: functional exercises with quantitative feedback in a gravity-reduced environment. IEEE Trans Neural Rehabil Eng 2006, 14:378-389.

(Continued)

*Primary Examiner* — Oren Ginsberg
*Assistant Examiner* — Garrett Atkinson
(74) *Attorney, Agent, or Firm* — Thomas | Horstemeyer, LLP

(57) ABSTRACT

In one embodiment, an exercise apparatus for exercising an arm includes a lever adapted to attach to a wheel of a wheelchair, a forearm support pivotally mounted to the lever that is adapted to support a forearm of a wheelchair user during exercise, and a resilient member attached to the lever that is adapted to resist movement of the lever by the user.

20 Claims, 9 Drawing Sheets

(51) Int. Cl.

| | |
|---|---|
| ***A63B 21/00*** | (2006.01) |
| ***A63B 23/035*** | (2006.01) |
| ***A63B 23/12*** | (2006.01) |
| *A63B 22/00* | (2006.01) |

(56) References Cited

U.S. PATENT DOCUMENTS

| | | | | |
|---|---|---|---|---|
| 3,103,357 | A * | 9/1963 | Berne | 482/118 |
| 4,407,496 | A * | 10/1983 | Johnson | 482/97 |
| 4,506,900 | A * | 3/1985 | Korosue | 280/250.1 |
| 4,560,181 | A * | 12/1985 | Herron | 280/250.1 |
| 4,641,833 | A * | 2/1987 | Trethewey | 482/95 |
| 4,700,962 | A * | 10/1987 | Salmon | 280/220 |
| 4,765,614 | A * | 8/1988 | Shute | 482/133 |
| 4,911,435 | A * | 3/1990 | Johns | 482/137 |
| 4,966,362 | A * | 10/1990 | Ramaekers | 482/148 |
| 4,993,732 | A * | 2/1991 | Wedemeyer | 280/250.1 |
| 5,242,179 | A * | 9/1993 | Beddome et al. | 280/233 |
| 5,303,945 | A * | 4/1994 | Oxford | 280/304.1 |
| 5,407,414 | A * | 4/1995 | Bass | 482/129 |
| 5,509,673 | A * | 4/1996 | Wu et al. | 280/250.1 |
| 5,709,631 | A * | 1/1998 | Kleinsasser | 482/51 |
| 5,988,661 | A * | 11/1999 | Garfinkle | 280/250.1 |
| 6,048,292 | A * | 4/2000 | Gasquez | 482/130 |
| 6,196,565 | B1 * | 3/2001 | Chubbuck | 280/255 |
| 6,247,715 | B1 * | 6/2001 | Korosue | 280/242.1 |
| 6,334,624 | B1 * | 1/2002 | Giglio | 280/304.1 |
| 6,613,000 | B1 * | 9/2003 | Reinkensmeyer et al. | 600/587 |
| 6,634,663 | B2 * | 10/2003 | Mitchell | 280/250.1 |
| 6,889,991 | B1 * | 5/2005 | Facer et al. | 280/244 |
| 7,303,513 | B1 * | 12/2007 | Curtiss | 482/130 |
| 7,306,548 | B2 * | 12/2007 | Martin et al. | 482/92 |
| 7,341,267 | B2 * | 3/2008 | Vroom | 280/250 |
| 7,604,572 | B2 * | 10/2009 | Stanford | 482/51 |
| 7,677,586 | B2 * | 3/2010 | Bloom | 280/250.1 |
| 7,942,839 | B2 * | 5/2011 | Cohen et al. | 602/16 |
| 7,955,238 | B2 * | 6/2011 | Dokshutsky | 482/129 |
| 8,201,842 | B1 * | 6/2012 | Waters et al. | 280/304.1 |
| 8,544,865 | B1 * | 10/2013 | Janikowski | 280/250.1 |
| 2004/0110610 | A1 * | 6/2004 | Chen et al. | 482/123 |
| 2005/0215400 | A1 * | 9/2005 | Nerenberg | 482/123 |
| 2012/0283076 | A1 * | 11/2012 | Hochberg et al. | 482/121 |

OTHER PUBLICATIONS

Gijbels D, Lamers I, Kerkhofs L, Alders G, Knippenberg E, Feys P: The Armeo Spring as training tool to improve upper limb functionality in multiple sclerosis: a pilot study. J Neuroeng Rehabil 2011, 8:5.

Feys HM, De Weerdt WJ, Selz BE, Cox Steck GA, Spichiger R, Vereeck LE, Putman KD, Van Hoydonck GA: Effect of a therapeutic intervention for the hemiplegic upper limb in the acute phase after stroke: a single-blind, randomized, controlled multicenter trial. Stroke 1998, 29:785-792.

Feys H, De Weerdt W, Verbeke G, Steck GC, Capiau C, Kiekens C, Dejaeger E, Van Hoydonck G, Vermeersch G, Cras P: Early and repetitive stimulation of the arm can substantially improve the long-term outcome after stroke: a 5-year follow-up study of a randomized trial. Stroke J Cereb Circ 2004, 35:924-9.

Whitall J, McCombe Waller S, Silver KH, Macko RF: Repetitive bilateral arm training with rhythmic auditory cueing improves motor function in chronic hemiparetic stroke. Stroke J Cereb Circ 2000, 31:2390-2395.

* cited by examiner

APPARATUSES AND METHODS FOR EXERCISING THE ARM

CROSS-REFERENCE TO RELATED APPLICATION(S)

This application claims priority to U.S. Provisional Application Ser. No. 61/654,371, filed Jun. 1, 2012, which is hereby incorporated by reference herein in its entirety.

BACKGROUND

Many persons with neurological injuries require a wheelchair for mobility assistance. When such persons have severely weakened arms and hands, they often cannot move the wheelchairs by themselves. Therapeutic exercise following a neurological injury can not only improve arm and hand function but can further help prevent secondary complications such as contractures. If a person could regain enough arm movement, he or she may then be able to operate a wheelchair without, or with less, assistance.

There are various ways in which such therapeutic exercise can be performed. One option is active assistance exercise facilitated by a trained therapist. Active assistance requires that the patient actively contribute to the movement, an aspect of training that is important for motor learning and plasticity. Active assistance also enables patients with a high level of impairment to participate meaningfully in therapy by limiting frustration, increasing motivation, and promoting self-efficacy. Active assistance may also enhance sensory input that drives motor plasticity and can demonstrate correct movement patterns that enable better learning. While such active assistance provides many benefits, one-on-one sessions with a trained therapist are expensive and therefore out of reach to many individuals.

Because of the expense involved with using a therapist, there has been a surge in the development of devices that partially automate rehabilitation exercise. For example, robotic therapy devices have been designed to provide "assistance-as-needed" to arm movement, mimicking the clinical technique of active assisted exercise. While such robots enable a variety of forms of active assistance, they are also relatively expensive and often complex, making them impractical for widespread use. In addition, the viability of using devices that can actively apply large forces to limbs in minimally supervised environments, such as at home, is still unclear.

Persons with arm weakness can exercise their arms on their own without using a therapist or a robotic therapy device. However, if their arms are severely impaired, such exercise is difficult and compliance with autonomous exercise programs is low.

In view of the above discussion, it can be appreciated that it would be desirable to have a simple and inexpensive apparatus and method that enable an individual to exercise his or her arm for therapeutic purposes.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

Figure 1:
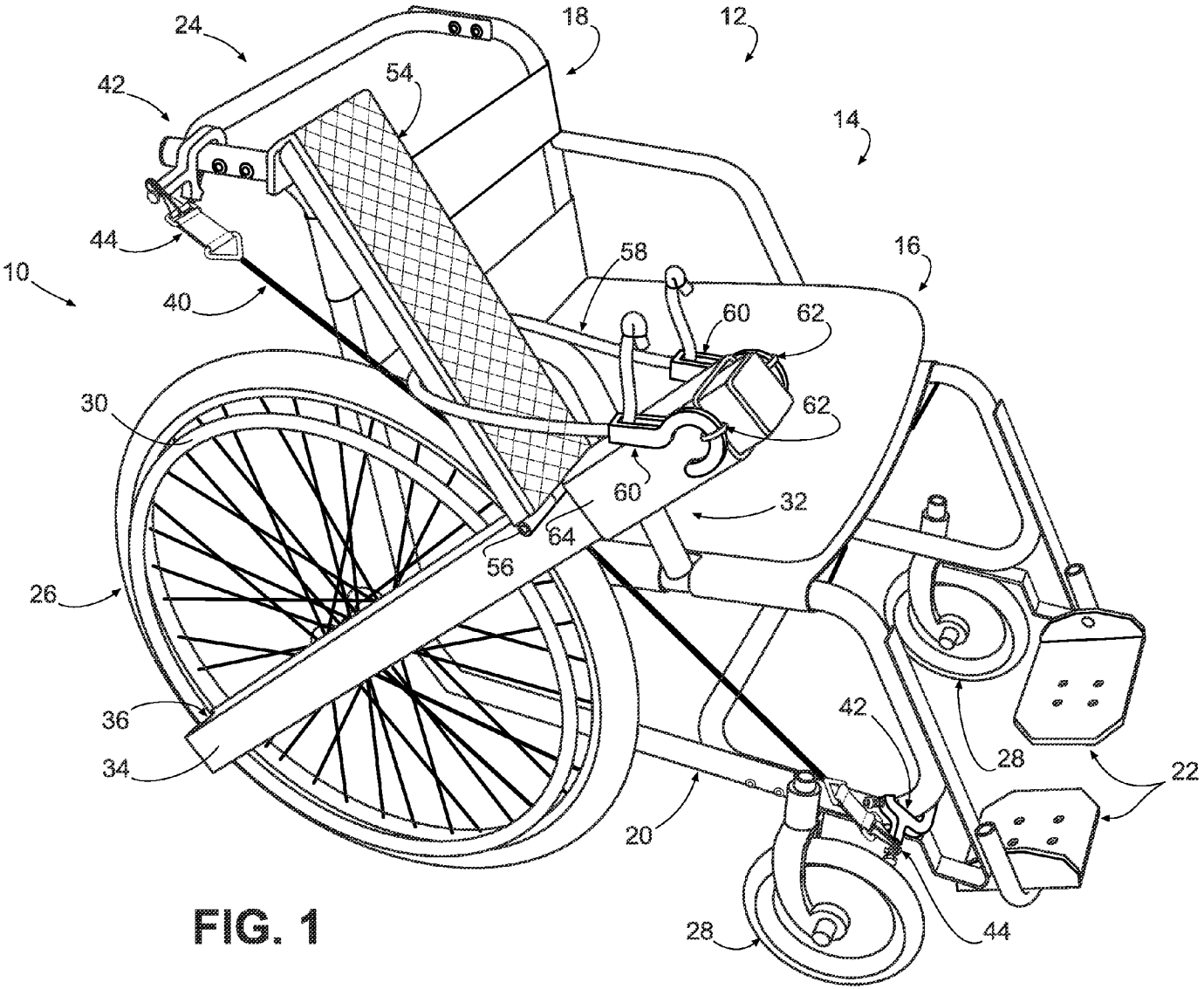
FIG. 1 is a side perspective view of an apparatus for exercising the arm shown attached to a wheelchair.

As described above, it would be desirable to have a simple and inexpensive apparatus and method that enable an individual to exercise his or her arm for therapeutic purposes. Disclosed herein are examples of such apparatuses and methods. In one embodiment, an exercise apparatus comprises a lever that attaches to a wheel of a wheelchair that a user can push and pull against a force provided by one or more resilient members. In some embodiments, the force is provided by one or more elastic bands that attach to the lever and the wheelchair. In further embodiments, the apparatus includes a forearm support that is adapted to support the user's arm during exercise.

In the following disclosure, various specific embodiments are described. It is to be understood that those embodiments are example implementations of the disclosed inventions and that alternative embodiments are possible. All such embodiments are intended to fall within the scope of this disclosure.

As described above, robotic arm therapy devices that incorporate actuated assistance can enhance arm recovery, motivate patients to practice, and allow therapists to deliver semi-autonomous training. However, because such devices are relatively expensive and complex, they have not achieved widespread use in rehabilitation clinics or at home. Disclosed herein are simple, mechanically-passive devices that provide robot-like assistance for active arm training using the principle of mechanical resonance.

The disclosed devices are based on two concepts. The first concept is to use resonance to assist movement. This concept was inspired in part by a previous study that found substantially improved, long-term recovery of arm movement ability when stroke patients rocked themselves in a rocking chair with their impaired arm, which was placed in an air splint, during subacute rehabilitation. Computer algorithms have previously been developed for robotic devices to provide assistance for rhythmic movements. However, a passive resonant system accomplishes this goal as well. Such a system oscillates with a larger amplitude when it is pushed at its resonant frequency because it stores and releases energy in a manner synergistic to the ongoing movement. A passive resonant system will not move unless pushed, fulfilling the requirement that the exercise be "patient active." Thus, resonance provides a way for weakened patients to amplify their movements, while still maintaining a causal relationship between amount of effort and size of the resulting movement.

The second concept is to integrate the resonant system with an existing, ubiquitous piece of rehabilitation equipment, i.e., a manual wheelchair. Many people with arm impairment after stroke or spinal cord injury use wheelchairs, and it is common for people with a neurological injury to spend substantial time in a manual wheelchair during rehabilitation. In addition, several low-cost wheelchairs have already been developed for use in resource-poor conditions. A strategy was to reversibly convert a manual wheelchair into a therapeutic technology for the severely weak arm, essentially dual-purposing the wheelchair so that it can be used as an exercise device and then quickly converted back to a mobility aid. This strategy has the advantages of convenience, accessibility, portability, lower net cost, and reduced need to transfer the patient to another device for exercise. Use of a manual wheelchair also provides a low-friction, high-mass base (because of the combined weight of the user and chair), which is ideal for achieving a system with a resonant frequency within a physiologic range.

A resonating wheelchair was developed that enables a wheelchair user to push and pull on a lever against a force provided by a resilient member to make the wheelchair roll back and forth relative to a neutral point. If the user pumps the lever at the resonant frequency of the system formed by the combination of the apparatus, the wheelchair, and the user, then the user's arm's active range of motion increases relative to that possible with a single push. Movements with increased range of motion better stretch soft tissue, which may help preserve the suppleness of the soft tissue and reduce spasticity and may also provide somatosensory stimulation that aids use-dependent plasticity. Furthermore, helping people with severe impairment create movements with an increased range of motion may provide a greater sense of self-efficacy, which may be important to motivate people with a severe motor impairment to exercise.

Figure 2:
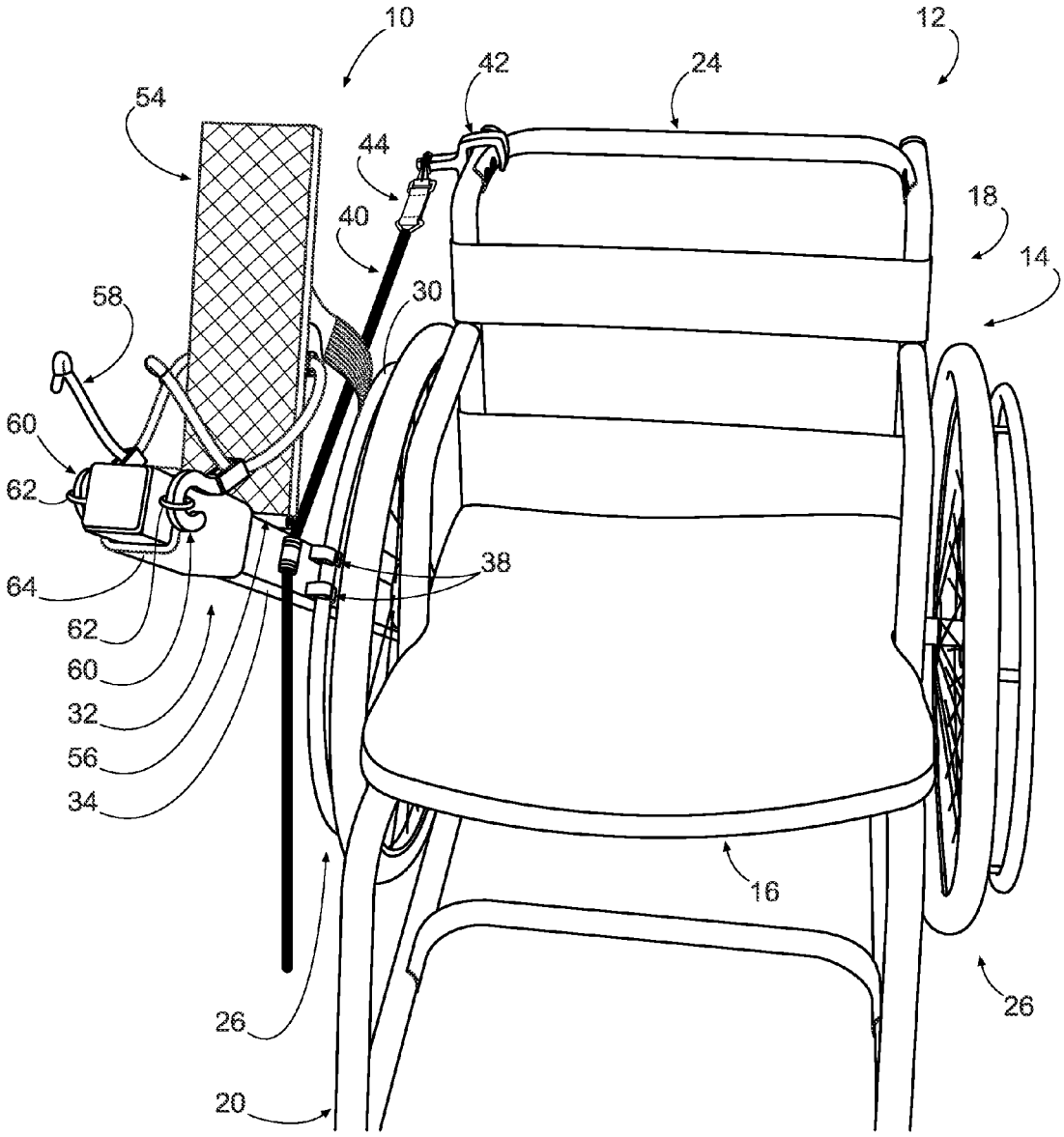
FIG. 2 is a partial front perspective view of the apparatus and wheelchair of FIG. 1.
Figure 3:
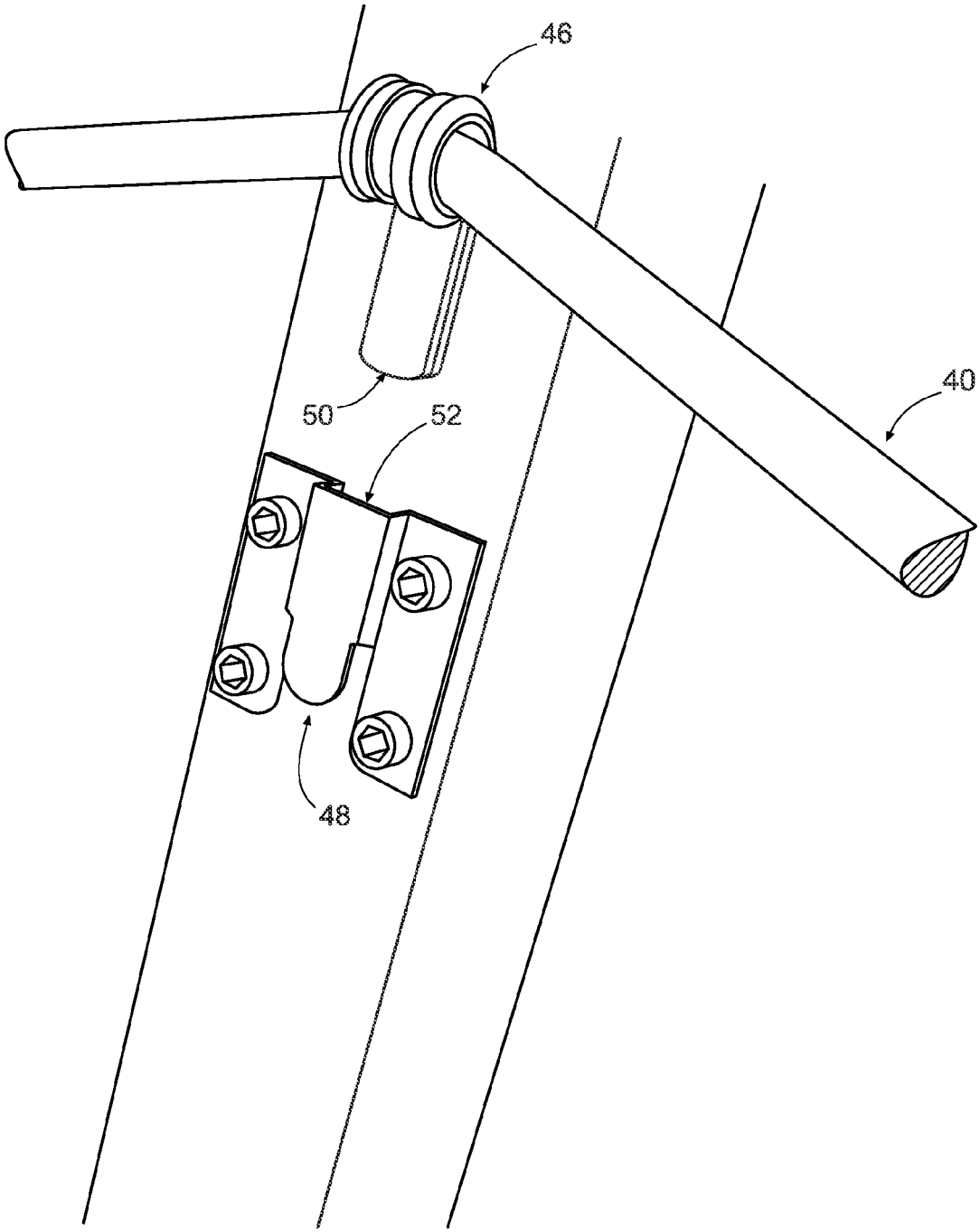
FIG. 3 is a detail view of mounting elements used to attach an elastic band of the apparatus shown in FIG. 1 to a lever of the apparatus.

FIGS. 1-3 illustrate an embodiment of an apparatus for exercising the arm 10 as applied to a conventional manual wheelchair 12. With reference to FIG. 1, the wheelchair 12 comprises a chair 14 that includes a seat 16 and a back support 18. The chair 14 is mounted to a frame 20 that comprises various tubes that define the structure of the frame and, as described below, provide attachment points for components of the exercise apparatus 10. One such attachment point can be a lower front portion of the frame 20 located near footrests 22 that are also mounted to the frame. Another attachment point can be an upper rear portion of the frame 20 to which a push handle 24 is mounted to the frame. It is noted that while these two locations can be attachment points for the above-noted components, other portions of the frame 20, or the wheelchair 12 in general, may be used as attachment points for the components. Although the exercise apparatus 10 is shown attached to the wheelchair 12, it is noted that the apparatus can be quickly and easily removed in order to use the wheelchair in the standard manner.

Further mounted to the frame 20 of the wheelchair 12 are rear wheels 26 and front wheels 28. The rear wheels 26 are relatively large and include push rims 30 that can be used by the wheelchair user to drive the wheelchair forward, rearward, left, or right. As is apparent from FIG. 1, the push rims 30 comprise tubular hoops having a circular cross-section. The push rims 30 are concentric with the wheels 26 and have a diameter that is slightly smaller than that of the wheels. The front wheels 28 are relatively small and can comprise caster wheels that can swivel to enable the wheelchair 12 to turn.

As shown in FIG. 1, the exercise apparatus 10 is attached to a right side of the wheelchair 12 to enable the wheelchair user to exercise his or her right arm. It is noted, however, that the apparatus 10 can alternatively be attached to the left side of the wheelchair 12 to enable the user to exercise his or her left arm. Irrespective of which side of the wheelchair 12 to which the apparatus 10 is attached, the apparatus includes a lever 32 that attaches to one of the rear wheels 26. In the illustrated embodiment, the lever 32 is attached to the push rim 30 of the right rear wheel 26. The lever 32 of the illustrated embodiment comprises an elongated tube 34 having a rectangular cross-section. By way of example, the tube 34 can be a 5 cm×5 cm square tube. The tube 34 has a length that enables the user to grip it comfortably and to rotate the wheel 26 when the user pushes or pulls on the tube. By way of example, the tube 34 is approximately 1 meter long. Irrespective of its particular configuration and dimensions, the tube 34 is made of a substantially rigid but lightweight material, such as aluminum or a polymeric material.

In the illustrated embodiment, the tube 34 attaches to the push rim 30 at two points, including a point near the bottom of the rim and a point near the top of the rim. As shown in FIG. 1, the tube 34 attaches to the bottom of the push rim 30 with a notch 36 that is formed in the bottom end of the tube. In some embodiments, the notch 36 is rounded and has a curvature that closely approximates the curvature of the tube of the push rim 30 (which has a circular cross-section). As shown in FIG. 2, the tube 34 attaches to the top of the push rim 30 with clamps 38 that are mounted to the tube at a medial position along an inside surface of the tube. In some embodiments, the clamps 38 are hook shaped and have a rounded inner surface that also closely approximates the curvature of the push rim tube. When the clamps 38 are brought into firm contact with the top of the push rim 30 while the bottom of the push rim is received in the notch 36, the lever 32 is secured to the wheel 26 and the wheel will rotate when the lever is pushed forward or pulled backward by the wheelchair user. It is noted that, while the clamps 38 have been described as being provided on a particular side of the tube 34, similar clamps can be provided on the opposite side of the tube to enable the lever 32 to be attached to the opposite rear wheel 26, which would enable the user to exercise the opposite arm.

With reference back to FIG. 1, the exercise apparatus 10 further includes a resilient member in the form of an elastic band 40 that provides resistance to movement of the lever 32 by the wheelchair user. Although the resilient member comprises an elastic band in the example of FIG. 1, it is noted that other resilient members, such as one or more compression or tension springs, can be used. By way of example, the elastic band 40 is made of a resilient material, such as rubber or silicone. In the illustrated embodiment, a first or lower end of the elastic band 40 attaches to the frame 20 of the wheelchair 12 at a position near the footrests 22. Specifically, the elastic band 40 attaches to a tube of the frame 20 with a tube clamp 42 having a fastener that can be tightened to secure the clamp to the tube. As is further shown in FIG. 1, the elastic band 40 can attach to the tube clamp 42 with an attachment hook 44 attached to the end of the band. A second or upper end of the elastic band 40 attaches to the frame 20 at a position near the push handle 24. Specifically, the elastic band 40 attaches to a tube of the frame 20 with a further tube clamp 42 to which the band attaches with a further attachment hook 44.

The elastic band 40 is also connected to the lever 32. As shown in FIG. 3, the elastic band 40 can attach to the tube 34 of the lever 32 using a mounting element 46 attached to the band at a medial position along its length, which is adapted to connect with a mounting element 48 that is attached to the inside surface of the tube 34. In the illustrated embodiment, the elastic band's mounting element 46 comprises a tang 50 that is adapted to be received by a slot 52 of the tube's mounting element 48. With such an attachment arrangement, the elastic band 40 can be independently held in tension from its lower end to the lever 32 and from its upper end to the lever. If the lever 32 is pushed forward, the segment of the elastic band 40 that extends from the rear end of the frame 20 to the lever 32 resists the movement. If the lever 32 is pulled backward, the segment of the elastic band 40 that extends from the front end of the frame 20 to the lever 32 resists the movement.

With reference to FIGS. 1 and 2, the exercise apparatus 10 further includes a forearm support 54 that is adapted to support the forearm of the wheelchair user when the apparatus is in use. In the illustrated embodiment, the support 54 comprises a generally rectangular platform that is pivotally mounted to a top side of the lever tube 34 with a hinge 56. In some embodiments, the forearm support 54 can be curved to more ergonomically fit the forearm and can be padded for comfort. The forearm support 54 is supported by a further resilient member in the form of an elastic band 58 that maintains the support in the orientation shown in the figures when the apparatus 10 is not in use and provides support to the user's arm when the apparatus is in use. As with the elastic band 40, the elastic band 58 is made of a resilient material, such as rubber or silicone. As shown in FIGS. 1 and 2, the elastic band 58 wraps around the underside of the forearm support 54 and attaches to the lever tube 34 at a point near the top end of the tube. In the illustrated embodiment, the elastic band 58 attaches to the tube 34 using hooks 60 that are secured to the band, which are received by eyelets 62 that are attached to the tube. The amount of support provided by the elastic band 58 can be adjusted by adjusting the points at which the hooks 60 are secured to the band. The elastic band 58 also attaches to the underside of the forearm support 54 to keep it in place relative to the support.

With continued reference to FIGS. 1 and 2, the exercise apparatus 10 further includes a grip 64 that the wheelchair user can grasp when using the apparatus. As shown in those figures, the grip 64 can be positioned below the points at which the elastic band 58 attaches to the tube 34. In some embodiments, the grip 64 is made of a resilient material, such as rubber or silicone.

Figure 4A:
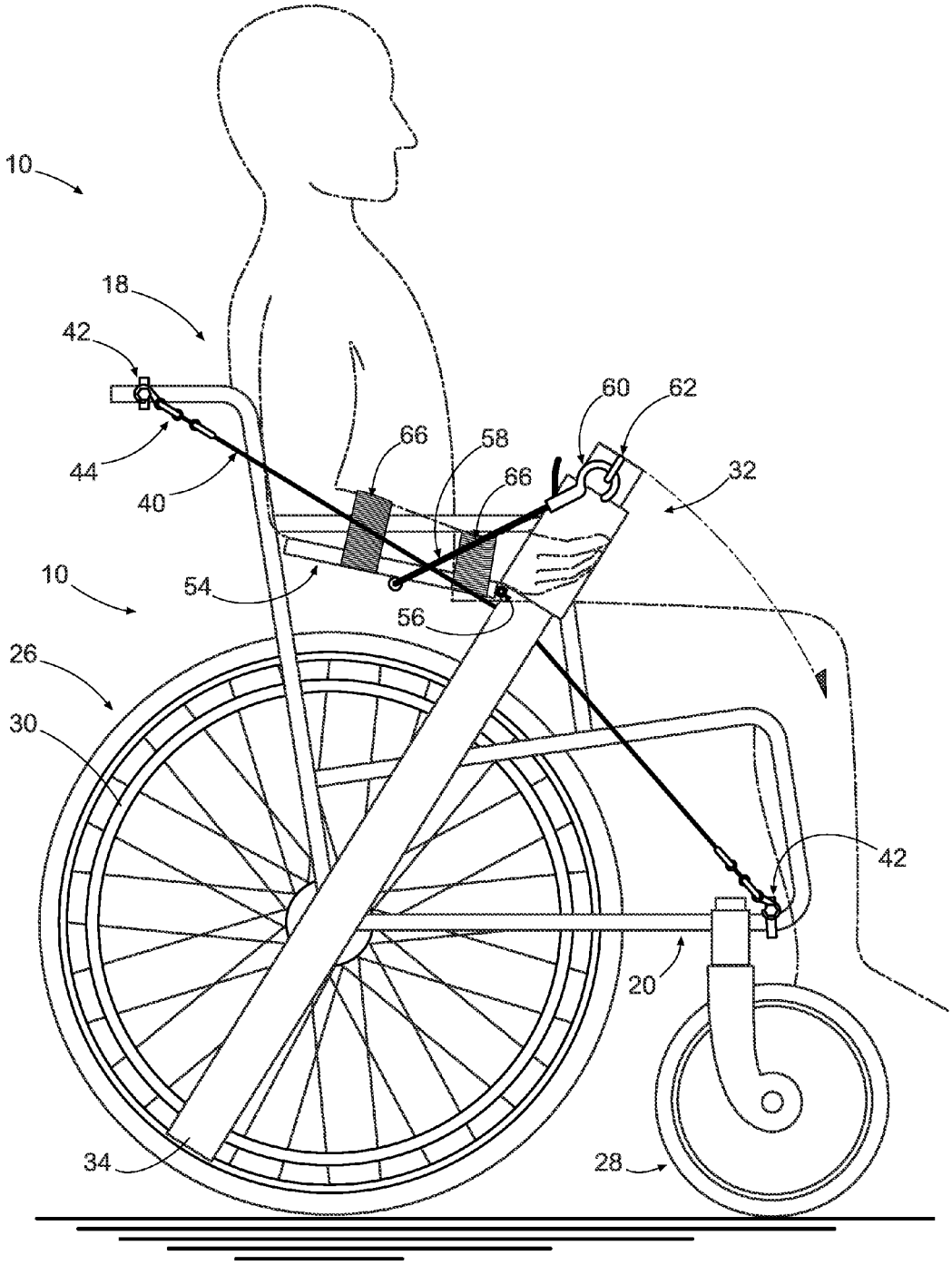
FIGS. 4A and 4B are side views illustrating use of the apparatus and wheelchair of FIG. 1.
Figure 4B:
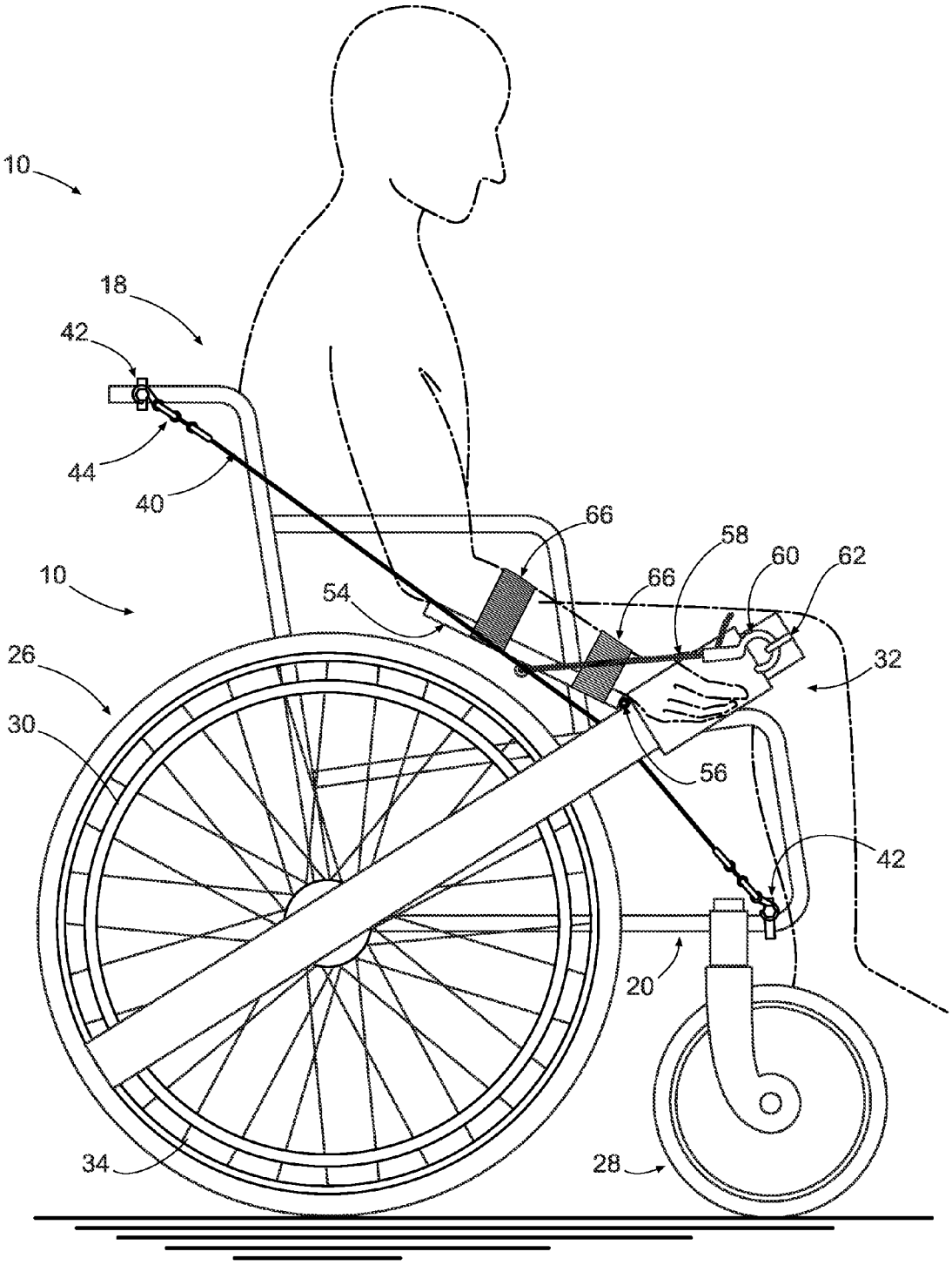

FIGS. 4A and 4B illustrate use of the exercise apparatus 10. During exercise, the user sits in the wheelchair 12 and places his or her forearm in the forearm support 54. The user can grasp the grip 64 of the lever 32 with a standard grip in which he or she grips the lever like a glass of water (shown), or with a "flat palm" grip in which his or her hand is secured to the lever with the fingers extended (not shown). In either case, the user's hand can be secured to the lever 32 and the user's forearm can be secured to the forearm support 54 with one or more straps 66. In some embodiments the straps 66 are adjustable and include hook-and-loop fastening elements (e.g., Velcro®).

Once the user is strapped to the apparatus 10, the user can push his or her arm forward from a neutral position shown in FIG. 4A, in which the hand is near the level of the lap, to a forward position shown in FIG. 4B, in which the hand is at a position below the knee. As the user pushes the lever 32 forward, the elastic band 40 resists the movement and applies a counter force that urges the lever back in the direction of its neutral position. The user can then allow the lever to return to the neutral position shown in FIG. 4A and then pull the lever backward from that position. When the user does this, the elastic band 40 again resists the movement and applies a counter force that also urges the lever back in the direction of its neutral position. The user can repeat this push-and-pull motion in a cyclical manner to provide exercise to the arm that requires one or more of shoulder flexion and extension, elbow flexion and extension, and wrist flexion and extension. As the user pushes the lever 32 forward and pulls the lever backward, the wheelchair gently rocks back and forth in a resonant manner. In some embodiments, the wheelchair 12 moves approximately 10 cm forward and backward from the neutral position during the rocking. The front wheels 28 can be clamped so that they are fixed parallel to the rear wheels in order to make the wheelchair 12 roll in a straight line even though it is only being driven by one wheel 26. Fixing the front wheels 28 in this manner also reduces the damping ratio of the system, because no energy is lost to the rotation of the front wheels out of the sagittal.

The exercise provided by the apparatus 10 assists the user in obtaining a larger range of motion (moving further away from the neutral position) if he or she rocks back and forth at the resonant frequency of the system. To appreciate the theoretical basis of the design, approximate the distributed system of mass, damping, and stiffness as a lumped-parameter, mass-spring-damper system, and assume a person can generate a maximum pushing force on the lever 32 equal to $F_{max}$. Next assume that the total stiffness of the elastic band 40 and the user's arm, acting in the direction of rocking motion of the lever 32, is K. In such a case, the maximum distance the hand moves when the person pushes with maximum force is:

$$X_{max} = \frac{F_{max}}{K} \qquad \text{[Equation 1]}$$

Now, if the system is resonant (i.e., the damping ratio $\zeta<0.707$) and the person pushes with a force $F=F_{max}\sin(\omega t)$, where w is the resonant frequency of the system, then the distance the hand moves will be:

$$X_{max} = \frac{F_{max}}{K}A, \qquad \text{[Equation 2]}$$

where the "movement amplification gain" A is given by:

$$A = \frac{1}{2\zeta\sqrt{1-\zeta^2}} \qquad \text{[Equation 3]}$$

This means that if the person periodically pushes with strength $F_{max}$ at just the right time, then the amplitude of the hand movement will grow to be A times larger than is possible with just a single maximum push. Note that A depends on the damping ratio $\zeta$, which is given by the stiffness K (set by the elastic band and biomechanical stiffness of the arm), damping C (set by the friction in the system and the biomechanical damping of the arm), and mass M (i.e., total inertia of the chair and lever and the person, including their body mass and the inertia of their arm) of the system according to:

$$\zeta = \frac{C}{2\sqrt{KM}} \quad \text{[Equation 4]}$$

Note that the average amplitude of the rocking is proportional to the average force applied to the lever 32. If the user stops pushing, the wheelchair 12 stops rocking. Therefore, the apparatus 10 requires active effort by the user and the user is rewarded with a larger range of motion if he or she tries harder and maintains the correct movement timing. Note also that it is important for the resonant frequency of the system to be within physiologic range for human movement (~1 Hz) while still providing appropriate range of motion of the arm. The resonant frequency is given by:

$$f = \frac{1}{2\pi}\sqrt{\frac{k}{M}} \quad \text{[Equation 5]}$$

The resonant frequency of the system is in physiologic range because the mass to be moved is large, as it includes the user's own mass combined with the mass of the wheelchair 12 as the wheelchair rolls.

Two pilot experiments were performed on an exercise apparatus similar to that described above. The first experiment was designed to test the hypothesis that the resonance provided by the exercise apparatus would amplify the active AROM of a user's arm. In this experiment, the step response of the apparatus was first measured with six volunteers who were victims of a chronic, severe stroke. To do this, the volunteers were asked to hold the lever but to relax the arm, and the experimenter pulled the lever forward approximately 40 degrees, extending the arm, and then released the apparatus two times. A tilt sensor (Nintendo®'s Wii Remote) attached to the lever measured the angle change of the device at 20 Hz and measured the damping ratio of the apparatus using a logarithmic decrement method. The sensor was placed 10 cm from the end of the lever on the bottom side. The resonant frequency of rocking, $\omega_{res}$, was predicted for each volunteer from the damped natural frequency of the step response, $\omega_d$, using the equation:

$$\omega_{res} = \omega_d \frac{\sqrt{1-2\zeta^2}}{1-\zeta^2} \quad \text{[Equation 6]}$$

The predicted step response of the apparatus (i.e., based on second-order, linear, mass-spring-damper model using the measured damping ratio and the measured damped natural frequency for each participant) was compared to the actual step responses that were measured.

To measure the unamplified range of motion, the six volunteers were asked to push and hold the lever as far forward as possible with their impaired arm three times, and then to pull and hold the lever as far backward as possible three times. The volunteers were monitored to ensure that they did not lean with their trunk to extend their AROM in the forward direction. To measure the effect of the mechanical resonance, the volunteers were asked to rock the lever at whatever frequency felt natural, and they were again monitored to prevent leaning. The goal was to determine if the volunteers would naturally rock at the resonant frequency and if the AROM achieved during rocking was greater than that achieved during the isolated, maximum effort push and pull, as predicted by the theory outlined above. Subjects performed informed consent according to the approved procedures of the U.C. Irvine Institutional Review Board.

A separate pilot study was also conducted of the exercise apparatus with different subjects to provide an initial assessment of the apparatus' value as a rehabilitation device. The question at issue was, "If individuals with a severe chronic stroke, who have finished formal rehabilitation and have reached a plateau of arm ability, exercise with the apparatus, will they improve their arm movement ability without experiencing an increase in arm pain?" For this study, eight stroke victim volunteers were recruited from the outpatient population of the Instituto Nacional de Neurología y Neurocirugía in Mexico City, and the volunteers provided informed consent according to the procedures approved by the INNN Institutional Review Board. Inclusion criteria were greater than six months post injury, moderate to severe arm movement impairment defined as an upper extremity Fugl-Meyer (FM) score less than 35 out of 66, and willingness to refrain from additional rehabilitation for the upper extremities during the six-week duration of the study. The average age of the participants was 52±15 years old.

The participants were assigned to two groups based on their availability. Participants in the Exercise-Rest group (n=3) exercised with the device for three consecutive weeks, and then rested for three consecutive weeks. Participants in the Rest-Exercise group (n=5) reversed the order of exercise and rest. Arm mobility typically reaches a plateau in chronic stroke victims by many measures, provided individuals maintain a relatively steady level of activity. The data from the Rest-Exercise group was used to confirm the well-known plateau for this study. The existence of the plateau enabled the use of the participant's baseline assessments as the control.

During the exercise period, the participants rocked the lever for a total of six hours in eight 45-minute sessions spread over the three weeks. They were continuously monitored by an investigator to ensure that they did not perform compensatory trunk movements or experience discomfort. The stiffness of the elastic band was increased after four sessions for every participant by stretching the band to a more extended operating point. Because the band stiffness increased with length, this increased the stiffness of the band. This was done to compensate for the fact that the band used in this study tended to mechanically wear out at the connection points to the chair.

The primary outcome measure was an automated measure of AROM of the arm obtained using the apparatus. AROM of the arm was quantified using an improved tilt sensor (ADXL 213) attached to the lever in the same manner described above. The participants were asked to rock 50 times, and the angle of the lever relative to the initial position at 50 Hz was recorded using a microcontroller (PIC 18F2455). The AROM was defined as the average amplitude of the angle change during rocking. The participants repeated this test three times per session to establish an average for that day. A baseline AROM measurement was obtained for each participant on a separate day before the participants began the exercise period. Then the AROM measurement was performed immediately before each of the eight exercise sessions. This provided a baseline measurement of AROM for each participant before they began therapy and eight measurements after therapy began. Secondary measures were the upper extremity FM score and subjective report of arm pain. The same non-blinded therapist evaluated the FM score at the start and end of both the three-week rest period and the exercise period and at a three-month follow-up evaluation. Each participant indicated his or her arm pain level before and after each session on a visual analog pain scale from 0 to 10, with 0 being no pain and 10 being the greatest pain possible.

When normality was confirmed, changes in the outcome measures were analyzed using parametric statistics including the t-test. If normality was violated, non-parametric statistics were used.

Figure 5:
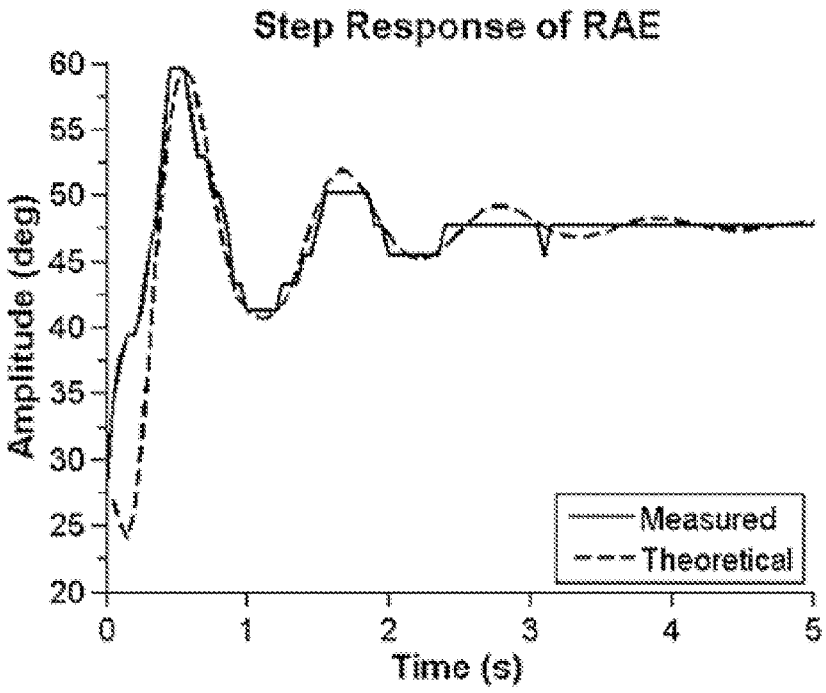
FIG. 5 is a graph of the step response of a test subject while using an exercise apparatus during an investigational study.
Figure 6:
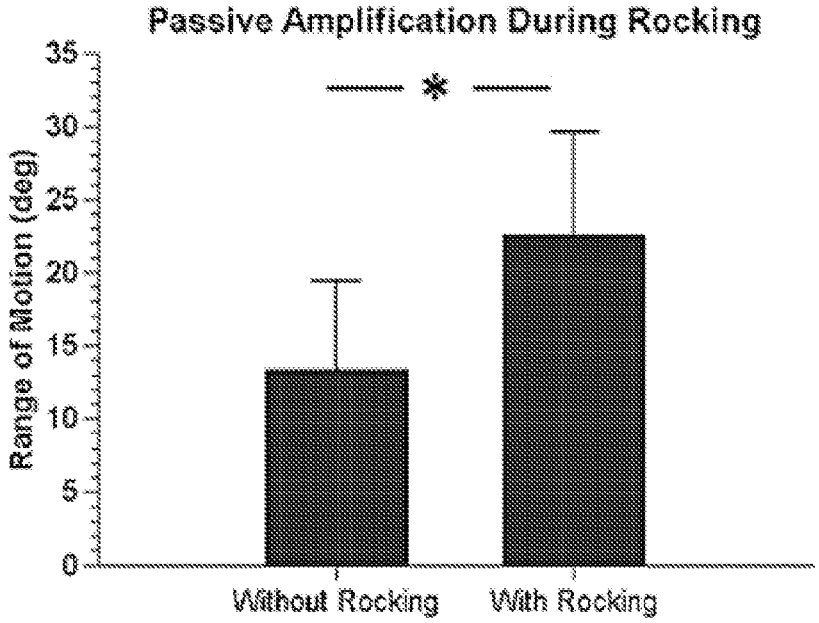
FIG. 6 is a graph of the total arm active range of motion (AROM) of chronic stroke victims while using the exercise apparatus. The amplitude of movement was 1.7 times larger when participants were rocking, which is a significant difference (p=0.041).

In a first experiment, whether or not the mechanical resonance property of the exercise apparatus would amplify arm AROM of participants with stroke (n=6) was tested. First, to verify that the system acts like an underdamped, linear second order system, the step response of the system was measured. The step response was well approximated by a second order linear model with a mean RMSE over 12 trials of 1.9±0.6 degrees (FIG. 5). The mean damping ratio was determined from the logarithmic decrement method to be 0.2±0.04, which yielded a predicted movement amplification gain of 2.6 if the participants chose to rock at the resonant frequency, according to Equation 3. Indeed, the subjects intuitively rocked at the resonant frequency when they were asked to rock the lever. The resonant frequency of the apparatus predicted using Equation 6 and data from the step response was 0.88±0.15 Hz, and the actual frequency the patients chose to rock at was 0.84±0.16 Hz, a non-significant difference (t-test, p=0.5). AROM, defined as the maximum angle change of the device from flexion to extension, increased significantly when the subjects rocked the apparatus compared to a single push and pull (Wilcoxon test, p=0.041), and the resulting amplification of the participants' range of motion was 1.7 (FIG. 6).

Figure 7A:
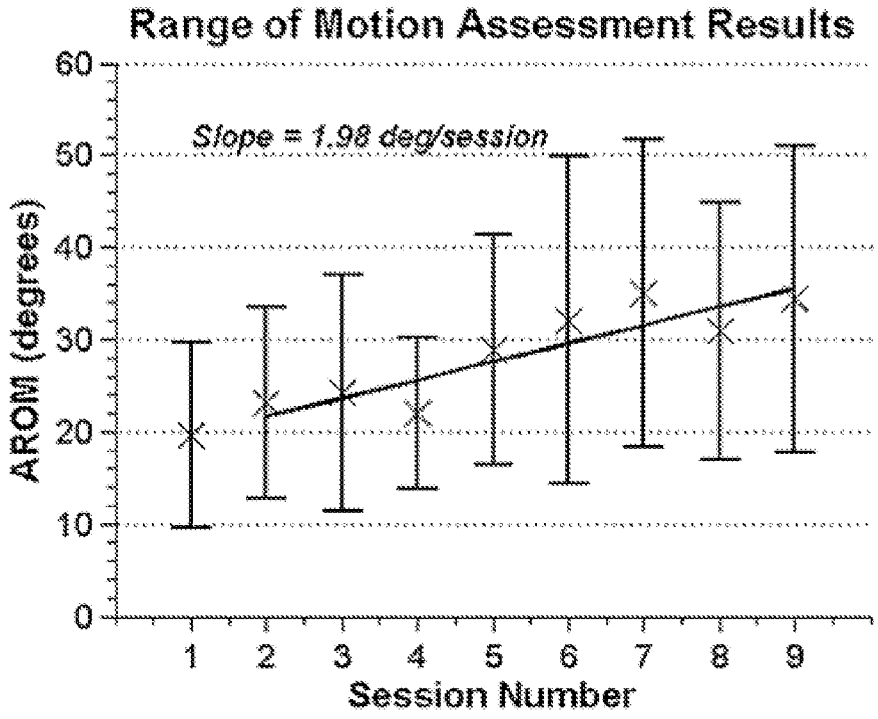
FIG. 7A is a graph of the mean functional AROM for size=x participants.
Figure 7B:
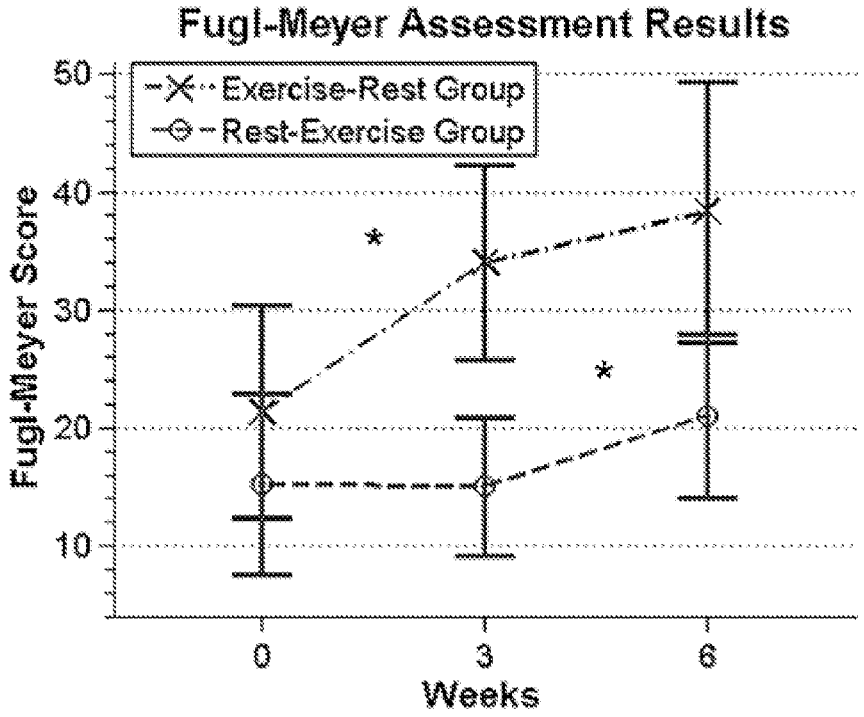
FIG. 7B is a graph of the mean Fugl-Meyer (FM) scores for Exercise-Rest (n=3) and Rest-Exercise (n=5) groups of the study. Significant changes are marked with an asterisk.

In a second pilot study with a different set of eight volunteers who were chronic stroke victims, the effect of repeated use of the apparatus on arm movement ability and arm pain for individuals who had ceased formal rehabilitation was measured. The mean initial FM score for the eight participants in the pilot study was 17±8 out of 66 points; i.e., the participants had substantial arm impairment. There was not a significant difference between the initial FM scores for each group (Wilcoxon rank sum test, p=0.29). The FM score of the Rest-Exercise group did not increase during the rest period (FIG. 7), indicating a stable baseline. This was expected for individuals who were on average 3±2 years post-stroke and had severe arm impairment.

Average AROM of the arm improved steadily across the three weeks of exercise (FIG. 7), with the average data being well fit by a line with a slope of about two degrees per session (R^2=0.80, p=0.003). Note that two participants who had full AROM along the apparatus at study start were excluded from this analysis. The overall average increase in AROM for the remaining six subjects was 14±9.8 degrees, or 66%±20%, after three weeks of the apparatus exercise.

Figure 8:
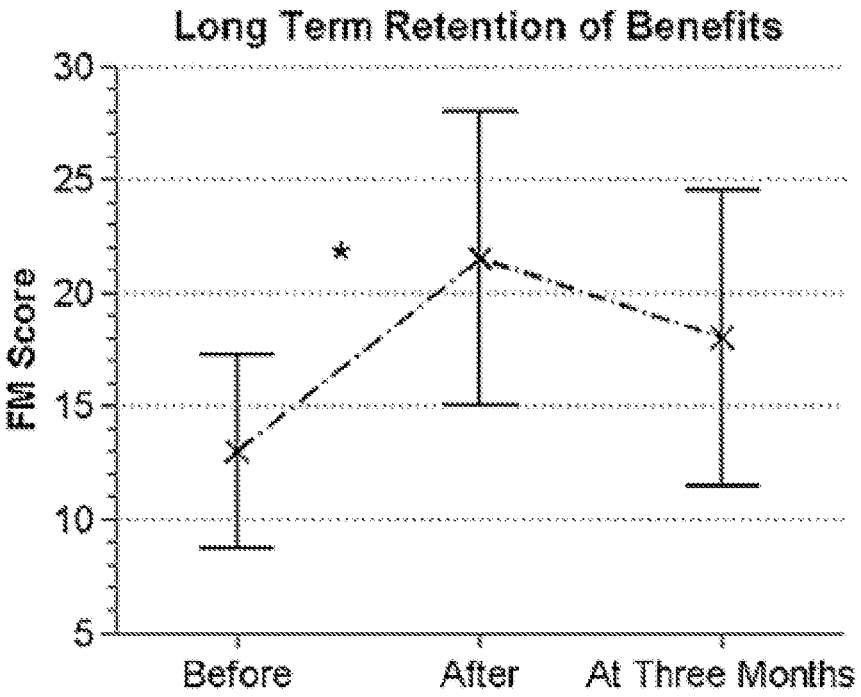
FIG. 8 is a graph of the mean median FM scores (n=6) from before therapy, immediately after therapy, and at a three-month follow-up assessment.

The mean change in FM score after three weeks of exercise with the exercise apparatus, averaged across all participants (n=8), was 8.5±4.1 points, while the mean change after the three-week rest period for all participants was 1.5±4. This difference was significant (t-test, p=0.009), with the assumption of normality confirmed for both change distributions (Lilliefors test, p=0.67 and 0.89, respectively). It was hypothesized that the small average improvement in FM score across all subjects during the rest period arose because the group that exercised with the apparatus first continued to improve during the subsequent rest period. Indeed, the FM score of the Exercise-Rest group (n=3) increased by 4.3±4.1 points during the rest period (FIG. 7) compared to a change in the Rest-Exercise group of −0.2±3.2 points during the rest period (i.e., a stable baseline, n=5), but this difference was not significant (t-test, p=0.13). FIG. 8 shows improvements in FM score were sustained at the three-month follow-up for six participants. Follow-up measurements were not obtained for the other two participants due to loss of contact. Because the sample size was small, a non-parametric test (Friedman test) was performed on the before, after, and three-month FM scores and again found a significant change in median score (p=0.042). The follow-up multiple comparison test showed no significant difference between the after and three-month scores (p=0.80).

Figure 9:
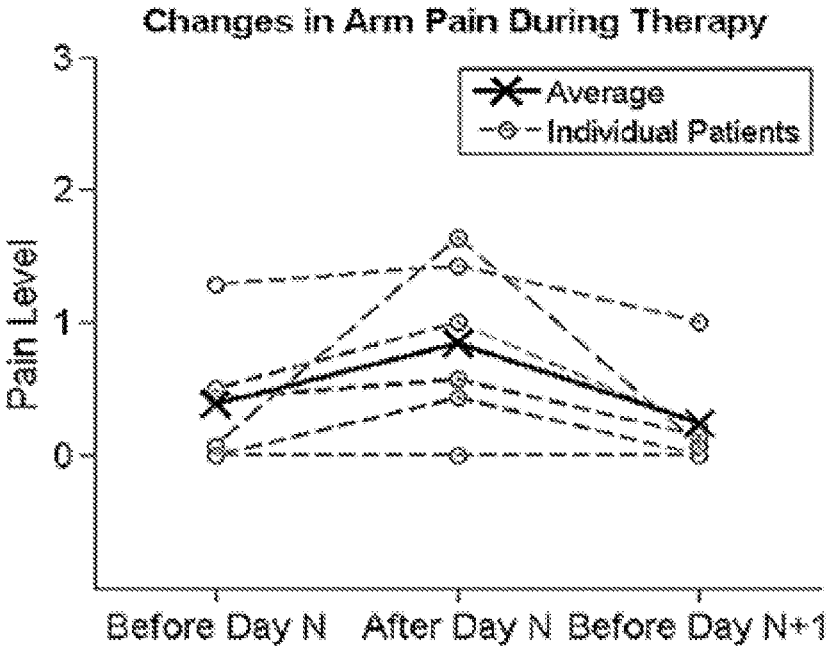
FIG. 9 is a graph of the results of the pain measurements showing the average perceived levels of pain before a session, after that session, and before the following session.

Participant rating of arm pain increased slightly by a non-significant amount (p=0.11) at the end of each exercise session relative to the beginning but returned to approximately its starting value by the next session (FIG. 9).

Figure 10A:
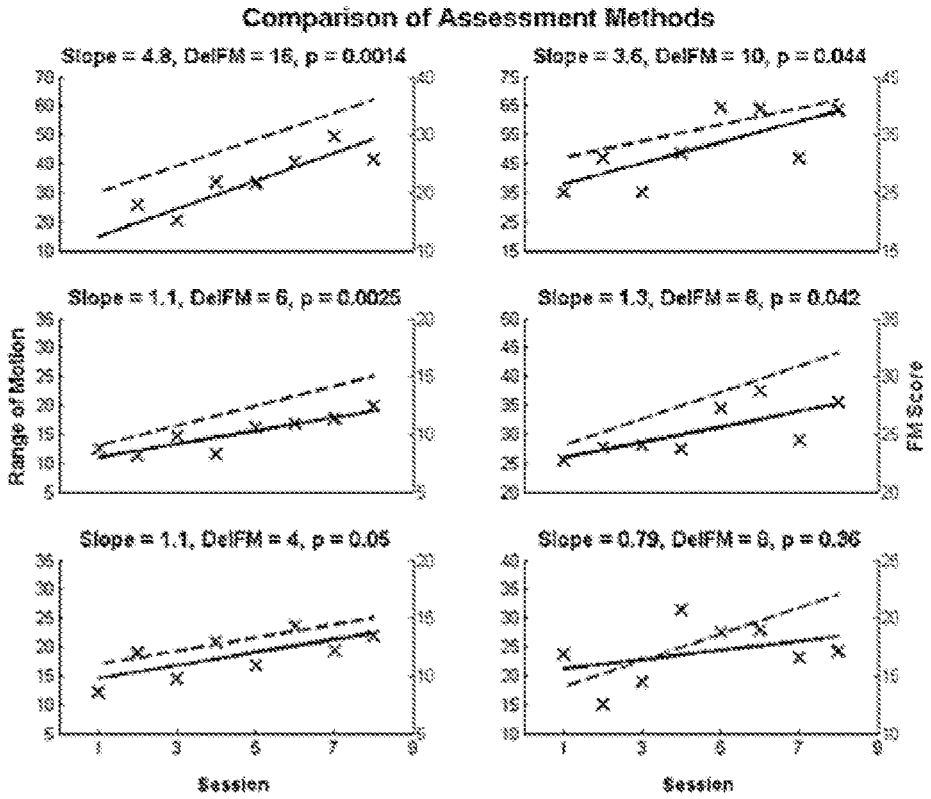
FIG. 10A is a graphical comparison of the FM and functional AROM assessments for six study participants. The solid lines represent the regression line for the functional AROM data, while the dashed lines show the change in FM score before and after training.
Figure 10B:
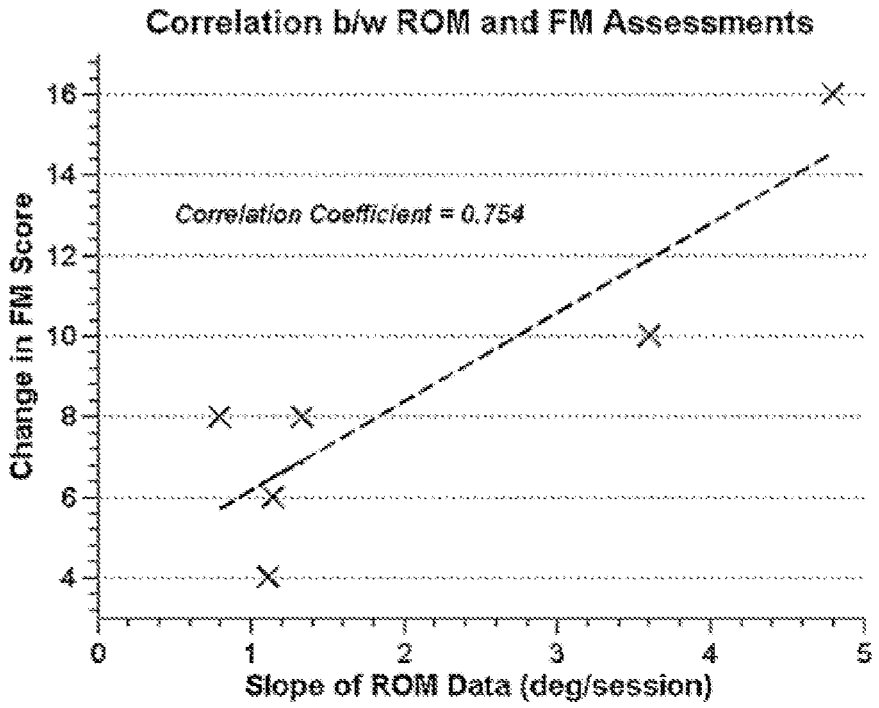
FIG. 10B is a graphical comparison of the slope of the functional AROM data versus the change in FM score for six participants. The dashed line is an estimate of a linear relationship between the two measurements (R2=0.759, p=0.01809).

Whether the changes in AROM correlated with the changes in FM score was analyzed. This analysis was performed for the same six participants included in the AROM analysis above (i.e., those six who could not push the wheelchair to its full range of motion). One of the data sets did not show significant change in AROM, but it was still included for completeness (FIG. 10). The slopes of the lines fit to the increases in AROM for each subject moderately correlated with their FM score changes (Spearman correlation, R=0.75, p=0.09).

Using the mean frequency from the AROM data of 0.87 Hz and an exercise period of about 40 minutes, it was estimated that the participants performed about 4,000 movements per session (2,000 flexions and 2,000 extensions). This assumes that the participants rocked continuously in each session, with no breaks for the entire 45-minute session, which was verified by the investigator who continuously monitored each session. This adds up to roughly 32,000 practice movements with a specific, intentional timing performed by each participant over the eight exercise sessions.

Various modifications and/or additions can be made to the exercise apparatus described herein. For example, the apparatus can include one or more sensors that can be used to measure the distances that the lever is moved by the user as well as the number of repetitions the user has performed. In addition, although the disclosure has been focused on the example of exercising the arm, the exercise apparatus can be modified to exercise other limbs of the body. For example, the apparatus could be modified to exercise one or more of the hip, knee, or ankle.

The invention claimed is:

1. An exercise apparatus for exercising an arm while sitting in a wheelchair, the apparatus comprising:

a lever adapted to attach to a rear wheel of a wheelchair, the wheel being mounted to a frame of the wheelchair;

a forearm support pivotally mounted to the lever that is adapted to support a forearm of a wheelchair user during exercise; and a resilient member attached to the lever and adapted to attach to the wheelchair frame in a manner in which the resilient member resists both forward and rearward movement of the lever by the user.

2. The exercise apparatus of claim 1, wherein the lever comprises a tube that is adapted to attach to a push rim of the wheel.

3. The exercise apparatus of claim 2, wherein the tube is adapted to attach to a bottom part of the push rim with a notch formed in a bottom end of the tube and to attach to a top part of the push rim with a clamp.

4. The exercise apparatus of claim 1, wherein the forearm support is mounted to a top side of the lever with a hinge.

5. The exercise apparatus of claim 4, further comprising a second resilient member attached to the forearm support and the lever that supports the forearm support.

6. The exercise apparatus of claim 5, wherein the second resilient member is an elastic band.

7. The exercise apparatus of claim 1, wherein the resilient member is an elastic band.

8. The exercise apparatus of claim 7, wherein the elastic band is attached to the lever at a medial position along the length of the lever.

9. The exercise apparatus of claim 1, wherein the resilient member includes tube clamps that are adapted to attach the member to tubes of the frame.

10. The exercise apparatus of claim 1, wherein the resilient member includes a first end that is adapted to attach to a front part of the wheelchair frame and a second end that is adapted to attach to a rear part of the wheelchair frame.

11. The exercise apparatus of claim 10, wherein the first end of the resilient member is adapted to mount to a front part of the wheelchair frame that is lower than an axis of the rear wheel and the second end of the resilient member is adapted to mount to a rear part of the wheelchair frame that is higher the axis of the rear wheels.

12. The exercise apparatus of claim 11, wherein the first end of the resilient member is adapted to mount to a point on the frame near footrests of the wheelchair and the second end of the resilient member is adapted to mount to a push handle of the wheelchair frame.

13. The exercise apparatus of claim 1, wherein the resilient member comprises two elastic bands, one adapted to attach to the front part of the wheelchair frame and another adapted to attach to the rear part of the wheelchair frame.

14. An exercise apparatus for exercising an arm while sitting in a wheelchair, the apparatus comprising:

a lever adapted to attach to a rear wheel of a wheelchair, the wheel being mounted to a frame of the wheelchair;

a forearm support pivotally mounted to the lever that is adapted to support a forearm of a wheelchair user during exercise; and an elastic band including a first end that is adapted to attach to a front part of the wheelchair frame at a point below an axis of the rear wheel, a second end that is adapted to attach to a rear part of the wheelchair frame at a point above the axis of the rear wheel, and a medial portion that is attached to the lever, wherein the elastic band resists both forward and rearward movement of the lever by the user.

15. The exercise apparatus of claim 14, wherein the lever comprises a tube that is adapted to attach to a push rim of the wheel.

16. The exercise apparatus of claim 15, wherein the tube is adapted to attach to a bottom part of the push rim with a notch formed in a bottom end of the tube and to attach to a top part of the push rim with a clamp.

17. The exercise apparatus of claim 14, wherein the forearm support is mounted to a top side of the lever with a hinge.

18. The exercise apparatus of claim 17, further comprising a second elastic band attached to the forearm support and the lever that supports the forearm support.

19. The exercise apparatus of claim 14, wherein the elastic band includes tube clamps that are adapted to attach the band to tubes of the frame.

20. The exercise apparatus of claim 14, wherein the first end of the elastic band is adapted to mount to a point on the frame near footrests of the wheelchair and the second end of the elastic band is adapted to mount to a push handle of the wheelchair frame.

* * * * *